United States Patent [19]

Salzer

[11] 4,210,892

[45] Jul. 1, 1980

[54] ELECTRIC FUSE HAVING HELICALLY WOUND FUSIBLE ELEMENTS

[75] Inventor: Erwin Salzer, Waban, Mass.

[73] Assignee: Gould Inc., Rolling Meadows, Ill.

[21] Appl. No.: 11,398

[22] Filed: Feb. 12, 1979

[51] Int. Cl.[2] ..... H01H 85/04

[52] U.S. Cl. ..... 337/161; 337/159; 337/162; 337/293

[58] Field of Search ..... 335/161, 162, 159, 158, 335/160, 164, 293, 292

[56] References Cited

U.S. PATENT DOCUMENTS

| | | | |
|---|---|---|---|
| 4,093,932 | 6/1978 | Kozacka | 337/159 |
| 4,099,156 | 7/1978 | Salzer | 337/293 |
| 4,153,892 | 5/1979 | Kozacka | 337/159 |

*Primary Examiner*—Harold Broome
*Attorney, Agent, or Firm*—Erwin Salzer

[57] ABSTRACT

An electric fuse for elevated circuit voltages, such as, e.g. 5 to 15 KV. It includes a tubular casing or electric insulating material, terminal elements and a pulverulent arc-quenching filler. It further includes a plurality of equidistantly spaced fusible elements electrically connected in parallel, wound substantially helically in planes defining a prism and forming part of a current path conductively interconnecting the pair of terminal elements.

The point of novelty consists in that the fusible elements are formed by a unitary metal stamping. That stamping also includes aligned metal bridges conductively interconnecting all the fusible elements. The preferred number of planes or sides of the aforementioned prism is four and the preferred number of bridges is n−1 for each quarter turn of the fusible elements, wherein n is the number of fusible elements connected in parallel. The bridges are arranged in spaced relation from the edges of the prism. In case of a four-sided prism one single bridge per plane per quarter turn of the fusible elements may suffice.

The fusible element stamping may also consist of a plurality of fusible element sections whose constituent fusible elements define serially related points of reduced cross-sectional areas which are different for different stamping sections.

5 Claims, 5 Drawing Figures

ELECTRIC FUSE HAVING HELICALLY WOUND FUSIBLE ELEMENTS

BACKGROUND OF THE INVENTION

The closest prior art I am familiar with is patent application Ser. No. 849,171, filed Nov. 7, 1977, to Frederick J. Kozacka for FUSE HAVING NOVEL FUSIBLE ELEMENT AND PROCESS OF MANUFACTURING SAID ELEMENT, now U.S. Pat. No. 4,153,892.

In manufacturing electric fuses for elevated circuit voltages the problem arises of winding a plurality of fusible elements in equidistantly substantially helical turns around planes which define a prismatic solid. To this end the edges of that solid are either marked equidistantly, or provided with recesses which support the fusible elements equidistantly. The helical winding of the individual elements is effected one after the other, or sequentially. A build-up of such a fuse is expensive because of the plurality of winding operations involved.

The above Kozacka patent proposes to produce composite fusible elements which can be wound simultaneously around a helical surface rather than in sequential steps. This is achieved by members of insulating material tying together the fusible elements at equidistantly spaced, fixed points thereof. The spacing of the fixed points is such that the members are situated between the edges of the prism rather than at the edges thereof when the plurality of fusible elements is wound around the prism.

The way of manufacturing fusible elements disclosed in the above Kozacka application achieves the intended goal, but at relatively high cost because the tying together of fusible elements by insulating members is a rather complex, rather labor intensive operation. Kozacka has the advantage that his fusible element tying means also perform the secondary function of arc-voltage control, because they subdivide the fusible elements into zones which are directly exposed to the quenching action of the pulverulent arc-quenching filler, and into other zones where the arc-quenching filler is not directly acting upon the arc. However, this secondary beneficial effect of the insulating members of Kozacka can be achieved according to the present invention by simpler means, as will be shown below in greater detail.

It is, therefore, the primary object of the present invention to achieve the same, or substantially the same, results as the aforementioned patent application of Kozacka in a more cost-effective way.

Other object of this invention and advantages thereof will become apparent as this specification proceeds.

SUMMARY OF THE INVENTION

The novel features of this invention consist in a plurality of fusible elements that are to be spaced equidistantly, and equidistantly wound around the planes defining a prism, are formed by a unitary metal stamping including a plurality of metallic bridges interconnecting all of the fusible elements that are integrated into a single stamping. The metallic bridges are confined to the sides of the prism and spaced from the edges thereof. Said plurality of bridges are aligned and interconnect all of the fusible elements at least once in each of the planes of the prism for each full turn of said plurality of fusible elements.

DESCRIPTION OF PREFERRED EMBODIMENT

Figure 1:
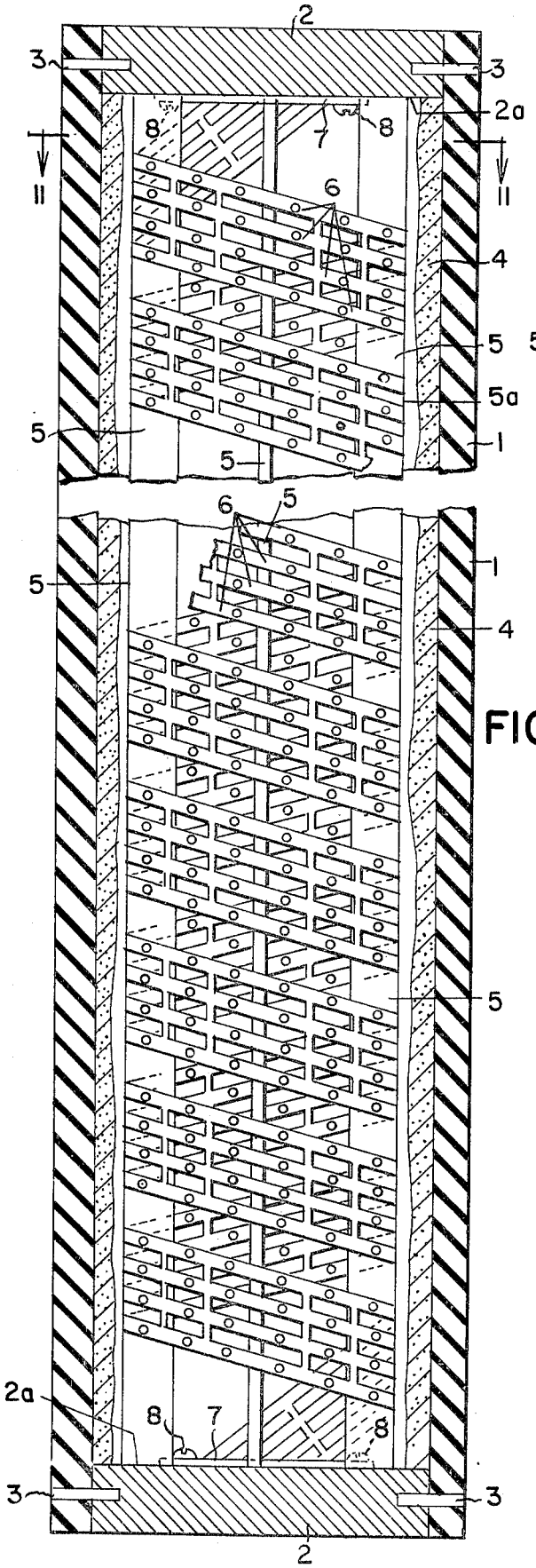
FIG. 1 shows a fuse embodying the present invention, partly in longitudinal section, and partly in side elevation.
Figure 2:
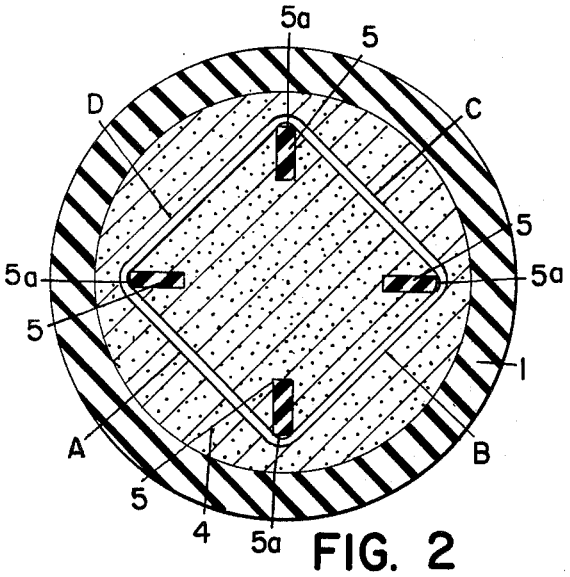
FIG. 2 is a section along II—II of FIG. 1.
Figure 4:
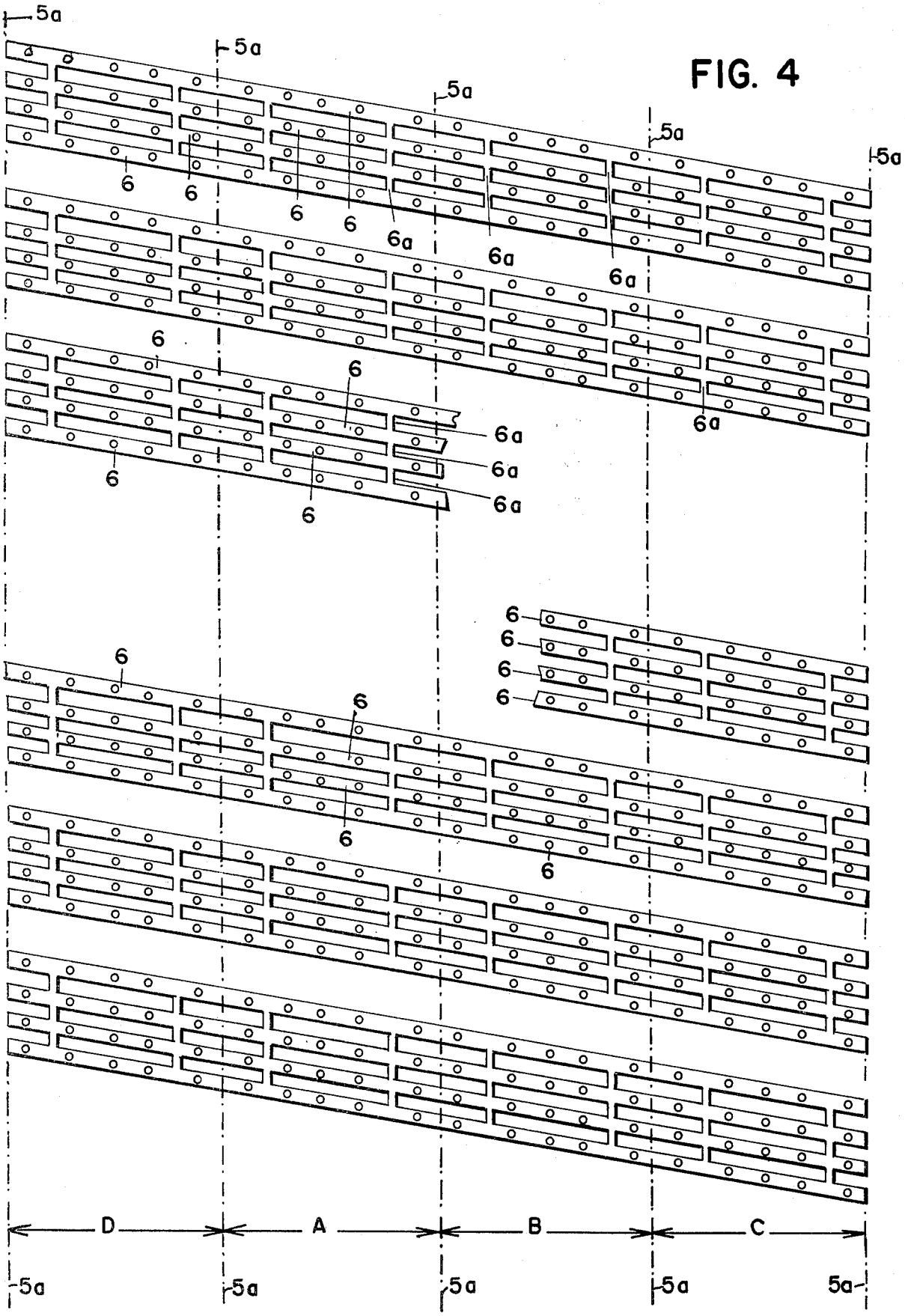
FIG. 4 shows the fusible elements of the structure of FIG. 1 unfolded into the plane of the paper on which FIG. 4 has been drawn.

Referring now to the drawings, and more particularly to FIGS. 1, 2 and 4 thereof, numeral 1 has been applied to indicate a tubular fuse casing of an electric insulating material such as, for instance, glass-cloth melamine. Casing 1 is closed at both ends thereof by terminal elements 2. In the instant case terminal elements 2 have the shape of metallic terminal plugs, plugging the open ends of casing 1. Steel pins 3 project transversely through casing 1 into terminal elements, or terminal plugs 2, and thus attach the latter to the former. A pulverulent arc-quenching filler 4 is filled into casing 1 and occupies all the space in casing 1 not occupied by other parts therein. In the embodiment shown in FIGS. 1 and 2 four electrical insulating bars or spacers 5 extend between terminal plugs 2. The bars or spacers 5 may consist of a material evolving arc-extinguishing gases under the action of electric arcs, such as laminates of glass-cloth and melamine resins, Or materials that do not evolve gases under the action of electric arcs such as, for instance, high alumina content ceramics, or bars or spacers 5 may consist in part of materials of the first mentioned kind, and in part of materials of the second mentioned kind. The axially outer ends of bars 5 are inserted into grooves (not shown) provided in the axially inner end surfaces 2*a* of terminal plugs 2 for receiving the axially outer ends of rods or spacers 5. It will be noted that rods 5 are preferably flat and are preferably displaced 90 deg. They are intended to support the fusible elements to which numeral 6 has been applied. The radially outer edges 5*a* of rods 5 (see FIG. 2) define the edges of a prism, and its intervening planes A,B,C,D define the sides of the prism. If desired, the number of edges 5*a* and the number of planes defining the above prism may be altered, i.e. either increased, or decreased. As shown there are four fusible elements 6 which are electrically connected in parallel, wound substantially helically in planes A,B,C,D which define the aforementioned prism having four edges 5*a*. Fusible elements 6 form a current path conductively interconnecting terminal elements 2. The ends of fusible elements 6 are clamped by bars 7 against the axially inner end surfaces 2*a* of terminal plugs 2. The clamping action of bars 7 is achieved by one or more clamping screws 8 each projecting transversely at two or more points through one of clamping bars 7 into one of terminal plugs 2. It will be noted that the pitch of the quarter turns of fusible elements 6 immediately adjacent terminal plugs 2 is greatly decreased in regard to the pitch of all the other portions of fusible elements 6.

The four fusible elements 6 shown in FIG. 1 are formed by a unitary metal stamping including a plurality of registering metallic bridges 6*a* interconnecting all of the four fusible elements 6. Bridges 6*a* are arranged in such a way that they are confined to the planes A,B,C,D of the aforementioned prism, and spaced from the edges 5a thereof. At least one set of bridges 6a interconnects all four fusible elements 6 in each of surfaces A,B,C,D at each full turn of fusible elements 6. FIG. 4 shows the four planes A,B,C,D and in each plane at two points thereof metallic bridges 6a are provided for each full turn, or 360 deg. turn, of the composite fusible element 6. The preferred number of metallic bridges 6a per quarter turn is thus two.

It will be noted that the width of each of bridges 6a is considerably smaller than the width of each of fusible elements 6. This is of crucial importance to minimize the amount of metal that must be vaporized when the fuse blows. Furthermore bridges 6a should be located in spaced relation from edges 5a. In this context the term bridge 6a is applied to indicate a metallic conductor which forms an integral part of the stamping of sheet metal of which all fusible elements are stamped out, and which conductively interconnects the constituent fusible elements of that stamping. Hence the thickness of fusible elements 6 and of bridges 6a are equal.

Figure 3:
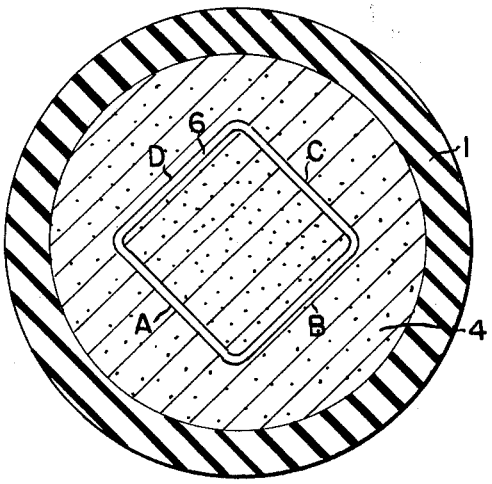
FIG. 3 is a section along II—II of FIG. 1 of a modification of FIG. 1.

The cross-section of FIG. 3 is the same as that in FIG. 2, except that the supports 5 are not present, i.e. that they have been removed during the process of manufacturing the fuse. How this can be achieved is described in detail in U.S. Pat. Nos. 3,839,786; Oct. 8, 1974 for PROCESS OF MANUFACTURING HIGH-VOLTAGE FUSES and 3,848,214; Nov. 12, 1974 for METHOD OF ASSEMBLING ELECTRIC HIGH-VOLTAGE FUSES AND SUBASSEMBLY THEREFOR, both of said patents being to Erwin Salzer. Reference may be had to them for information regarding manufacturing fuses whose fusible element structure is only supported by the pulverulent arc-quenching filler 4, and wherein skeletal supporting means for the fusible elements 6 such as, for instance, rods 5, are entirely dispensed with.

The structure of FIG. 5 will be described only to the extent that it differs from the structure of FIGS. 1 and 4.

Figure 5:
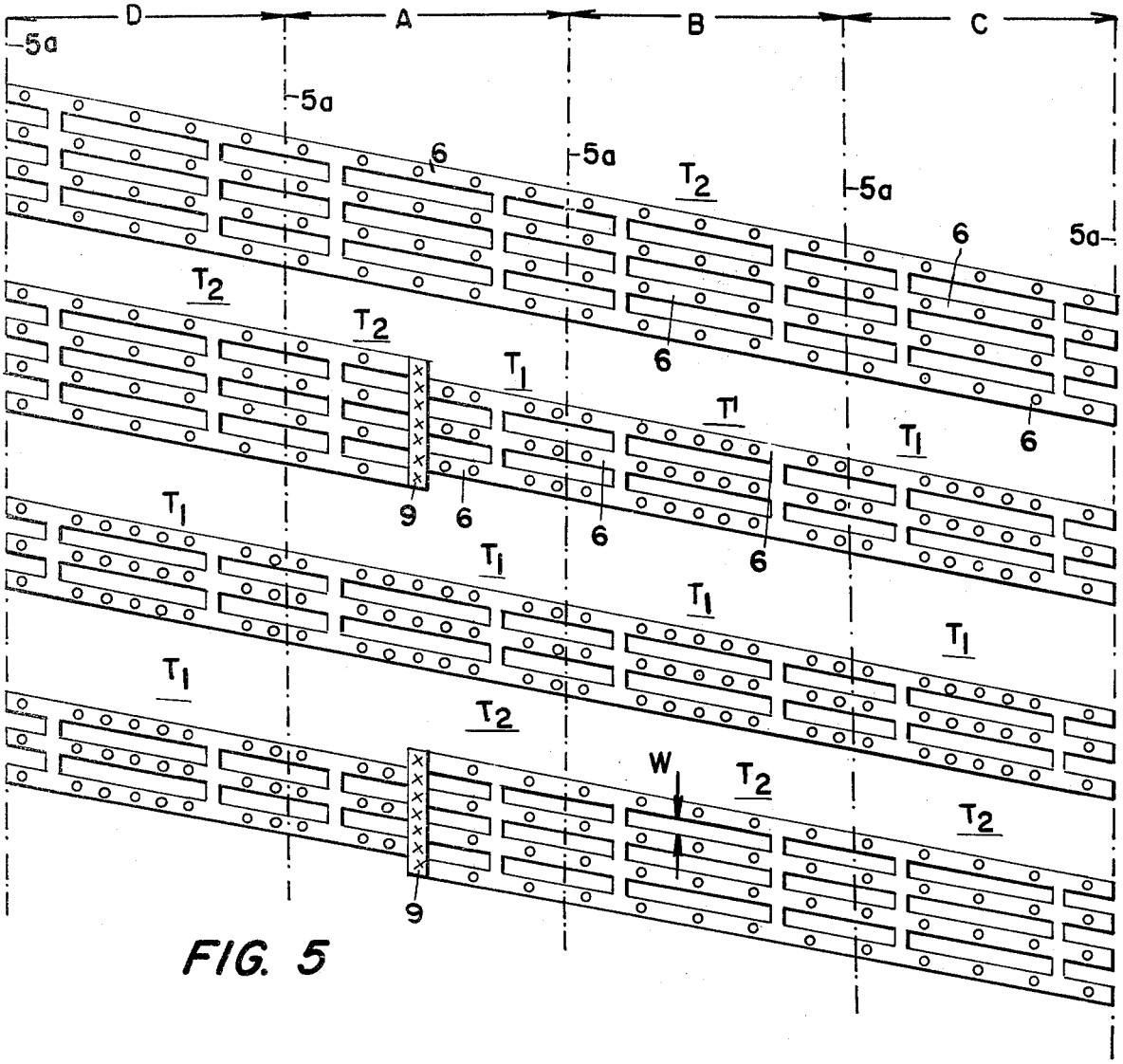
FIG. 5 is a modified composite fusible element shown in the same fashion as FIG. 4.

FIG. 5 illustrates a portion of an embodiment of the invention wherein each of a plurality of fusible elements 6 includes sections $T_1$, $T_2$ made of a different metal. For instance, the axially inner turn or turns $T_1$ may be made of silver, and the axially outer turn or turns $T_2$ may be made of copper. The conductivity and $i^2 \cdot t$ values of both metals are different and the price of silver much higher than that of copper. Since the melting and vaporizing $i^2 \cdot t$ value of silver is smaller than that of copper, this has the tendency of causing desintegration of section or sections $T_1$ ahead of desintegration of section or sections $T_2$ if sections $T_1$ and $T_2$ were made up of equal numbers of identical fusible elements. Since section or sections $T_1$ include three fusible elements 6 and sections $T_2$ include four fusible elements 6, the current density in sections $T_1$ will be larger than in sections $T_2$, assuming each constituent fusible element 6 of sections $T_1$ and sections $T_2$ to be identical. Thus the $i^2 \cdot t$ values of the points of reduced cross-sectional area of sections $T_1$ will be less than the $i^2 \cdot t$ values of the points of reduced cross-sectional area of sections $T_2$. If it is desired to limit the length of sections $T_1$ of silver to save on that metal, the arc voltage generated by fusion and vaporization of section or sections $T_1$ of silver may be increased per unit of length by increasing the number of perforations, or the number of points of reduced cross-sectional area of sections $T_1$. A reduction of the $i^2 \cdot t$ values of section or sections $T_1$ may also be achieved by reducing the size of the points of reduced cross-sectional area of its constituent fusible elements 6.

It will be apparent from the above that a fusible element according to the present invention provides a much greater freedom of "tayloring" of the arc-voltage than the method described in the above referred-to U.S. patent application Ser. No. 849,717 consisting in providing points where the arc extinguishing filler has, and other points where the pulverulent arc extinguisher has not, immediate access to the arc resulting from fusion of the fusible elements.

As shown in FIG. 5 of the drawing, the fusible elements 6 of which section $T_1$ is made up interleave with the fusible elements 6 of which section $T_2$ is made up. Or, in other words, each fusible element of which section $T_1$ is made up registers with the gap formed between immediately adjacent fusible elements of which section $T_2$ is made up. Metal strips 9 are arranged at the abutting ends of the constituent fusible elements of sections $T_1$ and $T_2$, and bonded, or conductively connected to, said elements, as for instance, by spot welding. These spot welds have been indicated in FIG. 5 by small x symbols.

The spacing W between adjacent fusible elements should be sufficiently large to prevent merger of the fulgurites resulting from the arcs which are caused by evaporation of the metal of which the fusible elements 6 of sections $T_1$ and $T_2$ are made.

In FIGS. 4 and 5 the rectangular holes between contiguous equidistantly spaced fusible elements 6 and the circular perforations defining the points of minimal cross-sectional area are shown in a more or less diagrammatic fashion since their goemetry is not fixed, but subject to wide variations. A short time ago it would have been not possible to manufacture cost effectively fusible elements whose geometry is subject to so numerous variations as suggested in FIGS. 4 and 5. But this is now possible by the use of programmable punches, punching out of appropriate strips of sheet metal composite fusible elements such as shown in FIGS. 4 and 5, and other relatively complex fusible elements, and thus integrating into one stamping a plurality of fusible elements connected in parallel.

In all the figures the metal bridges 6a have been shown to be arranged in registry. This greatly simplifies the manufacture of composite fusible elements according to this invention.

If n=number of fusible elements connected in parallel;

p=number of planes of the prism;

i=number of points per plane where bridges are located;

L=the full axial length of the casing; and

BR=number of bridges. Then $$BR=(n-1)\cdot p\cdot i\cdot L \quad (1)$$

The preferred number of p=4 and i=2.

Hence $$BR=(n-1).8.L \quad (2)$$

These equations are applicable to the non-sectionalized embodiment of the invention as shown in FIGS. 1–4.

I claim as my invention:

1. An electric fuse for elevated circuit voltages including a tubular casing of an electric insulating material; a pair of terminal elements closing the ends of said casing; a pulverulent arc-quenching filler inside said casing; a plurality of equidistantly spaced fusible elements electrically connected in parallel wound substantially helically in planes defining a prism and forming part of a current path conductively interconnecting said pair of terminal elements, wherein the novel feature consists in that said plurality of fusible elements are formed by a unitary metal stamping including a plurality of aligned metallic bridges interconnecting all of said plurality of fusible elements, said plurality of metallic bridges being of smaller width than each of said plurality of fusible elements and arranged in such a way that they are confined to said planes of said prism and spaced from the edges thereof, said plurality of bridges interconnecting all of said plurality of fusible elements at least once in each of said planes of said prism for each full turn of said plurality of fusible elements.

2. An electric fuse as specified in claim 1 wherein said prism has four planes, and wherein said plurality of bridges interconnect all of said plurality of fusible elements twice in each of said four planes for each full turn of said plurality of fusible elements.

3. A fuse as specified in claim 1 wherein each of said plurality of fusible elements includes sections made of different metals, having a different conductivity and different $i^2 \cdot t$ values.

4. A fuse as specified in claim 3 wherein the constituent fusible elements of said sections define serially related points of reduced cross-sectional area and wherein said points of reduced cross-sectional area are different for different said sections.

5. A fuse as specified in claim 1 wherein each of said plurality of fusible elements includes a plurality of sections that comprise different numbers of fusible elements that are connected in parallel, the constituent fusible elements of said sections being arranged in interleaving relation and conductively connected in series at the point of junction of said sections.

* * * * *